US012790762B2

(12) United States Patent
Augustin

(10) Patent No.: US 12,790,762 B2
(45) Date of Patent: Nov. 10, 2026

(54) UNDER SLEEPER PAD

(71) Applicant: Getzner Werkstoffe Holding GmbH, Bürs (AT)

(72) Inventor: Andreas Augustin, Nüziders (AT)

(73) Assignee: Getzner Werkstoffe Holding GmbH, Bürs (AT)

( * ) Notice: Subject to any disclaimer, the term of this patent is extended or adjusted under 35 U.S.C. 154(b) by 435 days.

(21) Appl. No.: 18/536,553

(22) Filed: Dec. 12, 2023

(65) Prior Publication Data

US 2024/0191438 A1 Jun. 13, 2024

(30) Foreign Application Priority Data

Dec. 13, 2022 (AT) ..... A 228/2022

(51) Int. Cl.

| | |
|---|---|
| ***E01B 3/46*** | (2006.01) |
| ***E01B 1/00*** | (2006.01) |
| ***E01B 9/68*** | (2006.01) |
| *E01B 2/00* | (2006.01) |

(52) U.S. Cl.

CPC ..... *E01B 3/46* (2013.01); *E01B 1/001* (2013.01); *E01B 9/683* (2013.01); *E01B 2/00* (2013.01); *E01B 2204/01* (2013.01)

(58) Field of Classification Search

CPC . E01B 1/001; E01B 2/00; E01B 9/683; E01B 3/46; E01B 2204/01; E01B 3/44; E01B 9/68

See application file for complete search history.

(56) References Cited

U.S. PATENT DOCUMENTS 4,303,199 A * 12/1981 Eisses ..... E01B 27/04 238/382
4,652,495 A * 3/1987 Sato ..... E01B 1/004 264/45.6
2010/0320281 A1* 12/2010 Potocan ..... E01B 3/46 238/29

(Continued)

FOREIGN PATENT DOCUMENTS

AT 8297 B 7/1902
AT 506529 B1 5/2010

(Continued)

OTHER PUBLICATIONS

Four pages "Trackelast" Specialist Rail Solutions, undated admitted prior art, Dec. 1, 2021.

(Continued)

*Primary Examiner* — Cheng Lin
(74) *Attorney, Agent, or Firm* — Volpe Koenig

(57) ABSTRACT

An under sleeper pad (1) for fastening to an underside, situated opposite rails (2), of a sleeper (3), with the under sleeper pad (1) having at least one first, preferably porous material component (4) and at least one second porous material component (5) different than the first material component (4), the first material component (4) being more elastic than the second material component (5) and the second material component (5) being more plastic than the first material component (4), the first material component (4) being arranged exclusively in a first layer (6) of the under sleeper pad (1) and the second material component (5) being arranged exclusively in a second layer (7) of the under sleeper pad (1).

15 Claims, 3 Drawing Sheets

(56) References Cited

U.S. PATENT DOCUMENTS

| | | | | | |
|---|---|---|---|---|---|
| 2021/0212491 | A1 * | 7/2021 | Augustin | ..... | B32B 25/10 |

FOREIGN PATENT DOCUMENTS

| | | | | | |
|---|---|---|---|---|---|
| AT | 510274 | B1 * | 3/2012 | ..... | E01B 3/46 |
| AT | 521738 | A1 * | 4/2020 | ..... | E01B 11/56 |
| AT | 520879 | B1 | 8/2020 | | |
| CN | 104947548 | A * | 9/2015 | ..... | E01B 1/001 |
| DE | 10149308 | A1 * | 4/2003 | ..... | E01B 3/46 |
| EP | 0569867 | A1 * | 11/1993 | ..... | E01B 3/46 |
| EP | 0569867 | B1 | 10/1996 | | |
| EP | 0609728 | B1 * | 11/1997 | ..... | E01B 9/683 |
| EP | 2107074 | A2 * | 10/2009 | ..... | C08L 75/04 |
| EP | 2107074 | B1 | 8/2012 | | |
| ES | 2266378 | T3 * | 3/2007 | ..... | E01B 3/46 |
| FR | 2511405 | A1 | 2/1983 | | |
| JP | 2006037349 | A * | 2/2006 | | |
| WO | WO-2008101269 | A1 * | 8/2008 | ..... | E01B 3/46 |
| WO | WO-2019157540 | A1 * | 8/2019 | ..... | E01B 3/46 |
| WO | 2021250170 | A1 | 12/2021 | | |

OTHER PUBLICATIONS

Two pages "Isolgomma" Slitrack, undated admitted prior art, Dec. 1, 2021.

Two data sheets "Pandrol" (each with two pages), undated admitted prior art, Dec. 1, 2021.

2021 Test Report, Four pages with eight pictures showing prior art (from Test Report dated Feb. 28, 2022).

* cited by examiner

UNDER SLEEPER PAD

CROSS-REFERENCE TO RELATED APPLICATIONS

This application claims priority to Austrian Patent Application No. A 228/2022, filed Dec. 13, 2022, which is incorporated herein by reference as if fully set forth.

TECHNICAL FIELD

The present invention relates to an under sleeper pad for fastening to an underside, situated opposite rails, of a sleeper, with the under sleeper pad comprising at least one first, preferably porous material component and at least one second porous material component different than the first material component, the first material component being more elastic than the second material component and the second material component being more plastic than the first material component.

The invention also relates to a track system comprising at least one sleeper, rails arranged on the sleeper, and at least one under sleeper pad of the aforementioned type arranged underneath the sleeper.

BACKGROUND

In the case of rail tracks, such under sleeper pads are used for vibration damping, ballast protection and for improving the lateral transmission of force, the under sleeper pads being arranged on the underside of tracks that bear rails.

Under sleeper pads are already known from the prior art. Thus, for example, document WO 2019/157540 A1 discloses an under sleeper pad comprising at least one elastic layer with grains of a cork granulate that are distributed therein and a cellular synthetic elastomer. The cork granulate is relatively stiff and plastic, whereas the elastomer is relatively flexible and elastic. The combination of the two material components ensures both a certain degree of elastic damping and a form-fitting engagement, in particular in terms of the best possible lateral transmission of force, between the sleeper and the ballast.

However, a disadvantage of such under sleeper pads is that, owing to the mixing of the elastic material component and the plastic material component, in particular the mixing of cork grains and elastomer grains, within a layer, it is not possible to exploit the full potential of each individual material component.

SUMMARY

The object of the present invention is therefore to provide an under sleeper pad which is improved in relation to the prior art and in the case of which the respective material properties are utilized to the best possible extent.

This object is achieved by an under sleeper pad with one or more of the features described herein.

An under sleeper pad of the type mentioned in the introduction is provided, in which the first material component is arranged exclusively in a first layer of the under sleeper pad and the second material component is arranged exclusively in a second layer of the under sleeper pad.

The significant advantage of the invention is that the properties of the first, more elastic material component and of the second, more plastic material component are utilized better in separate or discrete layers and can be optimized in terms of the respective object.

Thus, the damping properties of the first, more elastic layer can be optimized to a much better extent if this layer contains only the first, more elastic material component.

The form-fitting penetration of the ballast into the under sleeper pad, which is important for ballast protection, that is holding the ballast in place underneath the sleeper, can be optimized to a much better extent if the second layer, which is nearer the ballast, contains only the second, more plastic material component.

The plastic deformation of the second material component in the second layer results expediently in a larger contact surface area between the sleeper and the ballast, this causing expedient distribution and transmission of force and stress.

As a result, an under sleeper pad according to the invention can fulfil the purposes mentioned in the introduction to a much better extent than conventional under sleeper pads of the prior art.

The at least one second material component is porous. The at least one first material component may be porous or compact, that is virtually without any internal cavities.

A porous material component can also be referred to as a foamed material component if the porosity is produced by a foaming process.

In a preferred embodiment variant, the at least one first material component is exactly one first material component.

In a preferred embodiment variant, the at least one second material component is exactly one second material component.

That is, it is preferably intended that for each layer exactly one single material component is provided. This variant is expedient when disposing of the under sleeper pad, since the individual material components can be separated from one another relatively easily and completely, and thus recycled particularly easily, by separating the layers from one another.

If two or more first material components are provided, all the first material components are more elastic than the at least one second material component.

If two or more second material components are provided, all the second material components are more plastic than the at least one first material component.

The at least one first material component may be a correspondingly elastic polyurethane, such as that sold on the market under the trade names Sylodyn and/or Sylomer.

The second material component used can be, for example, cork or correspondingly plastic polyurethane. The second layer may also contain, for example, two second material components in the form of cork and correspondingly plastic polyurethane.

Further advantageous embodiments of the invention are defined in the description and claims that follow.

It is particularly preferably provided that the first layer of the under sleeper pad is nearer the sleeper and the second layer is remote from the sleeper, which means that the second layer is nearer the ballast, in an operating position of the under sleeper pad.

It is preferably provided that the first layer and the second layer are connected to one another in contact with one another over all of one face.

It is preferably provided that the full-face connection between the first layer and the second layer is an integral bond, for example in the form of an adhesive bond or welded connection.

The adhesive or binder used to connect the first layer to the second layer and/or to further layers and/or to connect the under sleeper pad to the sleeper may be, for example, a one-component polyurethane binder such as isocyanate, but also a two-component polyurethane binder or other binders or mixtures of these binders.

However, it is also conceivable for the full-face connection between the first layer and the second layer to be a force fit and/or form fit, for example by means of toothings.

It is preferably provided that the first layer is formed from granulate grains connected to one another, in particular adhesively bonded to one another, and the granulate grains consist of the at least one first material component.

It is preferably provided that the second layer is formed from granulate grains connected to one another, in particular adhesively bonded to one another, and the granulate grains consist of the at least one second material component.

It is preferably provided that the granulate grains of the at least one first material component, such as correspondingly elastic polyurethane, in the first layer have a grain size in the range of 1 mm to 20 mm, preferably 1 mm to 12 mm.

It is preferably provided that the granulate grains of the at least one second material component, such as cork, in the second layer have a grain size in the range of 0.1 mm to 10 mm, preferably 0.5 mm to 8 mm.

However, it may also be provided that the granulate grains of the second material component of the second layer have a grain size in the range of 1 mm to 20 mm, preferably 1 mm to 12 mm, in particular when the second material component is correspondingly plastic polyurethane.

Regarding the terms "granulate" or "grain", it should be noted that a granulate can be understood to mean a substance composed of a multiplicity or accumulation of grains, or granulate grains, which are connected to one another by suitable measures. A grain, or granulate grain, is thus to be understood to mean a small individual body of a granulate which can also be referred to as flake, small piece, particle or the like. The term "grain" per se says nothing about its size and/or shape.

To connect the granulate grains, they can be in particular adhesively bonded or welded to one another. For adhesive bonding, it is possible to use in particular the aforementioned adhesive by means of which the first layer and the second layer can also be adhesively bonded to one another.

In the variants in which the first and/or the second layer of the under sleeper pad have interconnected granulate grains, recycled starting materials that are ground to form corresponding granulate grains can be reused particularly well.

As a departure from the aforementioned granulate variants, it may be provided that the first layer is in the form of an intrinsically homogeneous layer consisting of the at least one first material component as mono-material.

It may also be provided that the second layer is in the form of an intrinsically homogeneous layer consisting of the at least one second material component as mono-material.

A mono-material is to be understood in particular to mean a material, in particular of a single type, which is not formed of interconnected granulate grains but rather an intrinsically continuous material which contains no graining.

As a departure from the aforementioned use of recycled material, in principle the at least one first material component and/or the at least one second material component, irrespective of whether they are granulates or mono-materials, can also be newly produced or cast.

For the sake of completeness, it should be noted that all possible combinations of mono-material and granulate layers can be realized. Thus, the first layer and the second layer of an under sleeper pad according to the invention may each be formed of mono-material or granulate. However, the first layer of the under sleeper pad according to the invention may also be a mono-material, while the second layer of this under sleeper pad according to the invention is formed of granulate, and vice versa.

It is particularly preferably provided that the first layer has a smaller compression set than the second layer.

It is preferably provided that the first layer has a compression set less than or equal to 8%, preferably less than or equal to 6%.

It is preferably provided that the second layer has a compression set of at least 10%, preferably up to 24.5%.

The compression set is a parameter which describes the extent to which a material component, such as an elastomer, returns to its starting shape after application of load, or the extent of plastic deformation that remains after the load is removed. The compression set is preferably ascertained in accordance with DIN EN ISO 1856:2020-11, using method C (compressive deformation under specially defined conditions), during which storage at a temperature of 23+−2° C. and a relative air humidity of 50+−5% is performed for 72 hours and 25% deformation of the test specimen. In the event of determination of the compression set in this way, the sample geometry is expediently 25 mm×25 mm×12.5 mm.

In this respect, it should be noted that a difference between two compression set values of the order of magnitude of 1-2% corresponds to considerably different deformation behaviors. This also means that there is a clear difference between elastic and plastic material behaviors.

The porous and more plastic second layer can also be regarded as a type of load distribution layer.

The elastic, or plastic, properties result in particular from an interaction between multiple parameters, such as the porosity, the base material, the density, the cellularity and the production method, among many other things. This is known per se.

Regarding the density of the first layer and/or the second layer, it may be provided that the density of the first layer is expediently in the range of 150 kg/m3 to 1150 kg/m3, preferably in the range of 250 kg/m3 to 1150 kg/m3, and/or the density of the second layer is expediently in the range of 100 kg/m3 to 800 kg/m3, preferably in the range of 100 kg/m3 to 600 kg/m3.

It is preferably provided that the first material component is an in particular elastic polyurethane, preferably with a porosity in the range of 0% to 90%, particularly preferably with a porosity in the range of 0.1% to 85%.

This means that the first material component can be made of a polyurethane granulate and/or porous homogeneous polyurethane, but also compact polyurethane or another correspondingly elastic elastomer.

It is preferably provided that the second material component is a porous polyurethane, preferably with a porosity in the range of 2.5% to 90%, and/or that the second material component is a porous cork, preferably with a porosity in the range of 2.5% to 90%, particularly preferably with a porosity in the range of 5% to 75%.

The preferred minimum porosity of the at least one second layer of 2.5% ensures particularly well a sufficient volume displacement or compressibility of the second layer, with the result that the respective ballast grain can penetrate the second layer in a form fit and/or for a lengthy period of time and be embedded in the under sleeper pad by virtue of plastic deformation of the second layer.

It is particularly preferably provided that the first layer has a thickness in the range of 3 mm to 15 mm, preferably 4 mm to 12 mm.

It is particularly preferably provided that the second layer has a thickness in the range of 3 mm to 10 mm, preferably 4 mm to 8 mm.

It may also be provided that the first layer has a thickness which is between 40% and 85%, preferably between 50% and 75%, of an overall thickness of the under sleeper pad.

It may furthermore be provided that the second layer has a thickness which is between 15% and 60%, preferably between 25% and 50%, of the overall thickness of the under sleeper pad.

In addition to the under sleeper pad according to the invention per se, protection is also sought for a track system comprising at least one sleeper, rails arranged on the sleeper, and at least one under sleeper pad according to the invention arranged underneath the sleeper, the first layer of the under sleeper pad being nearer the sleeper and the second layer of the under sleeper pad being remote from the sleeper. The second layer is thus nearer to the ballast, when the track system is mounted on a ballast bed.

BRIEF DESCRIPTION OF THE DRAWINGS

Further advantages and details of advantageous variants of the invention will emerge from the figures and from the associated description of the figures. In the figures.

DETAILED DESCRIPTION

First of all, it should be said that all the figures are schematic illustrations which are not true to scale. Thus, for example, all layer thicknesses and their relative dimensions with respect to one another are selected such that they can be clearly illustrated in graphic terms.

Figure 1:
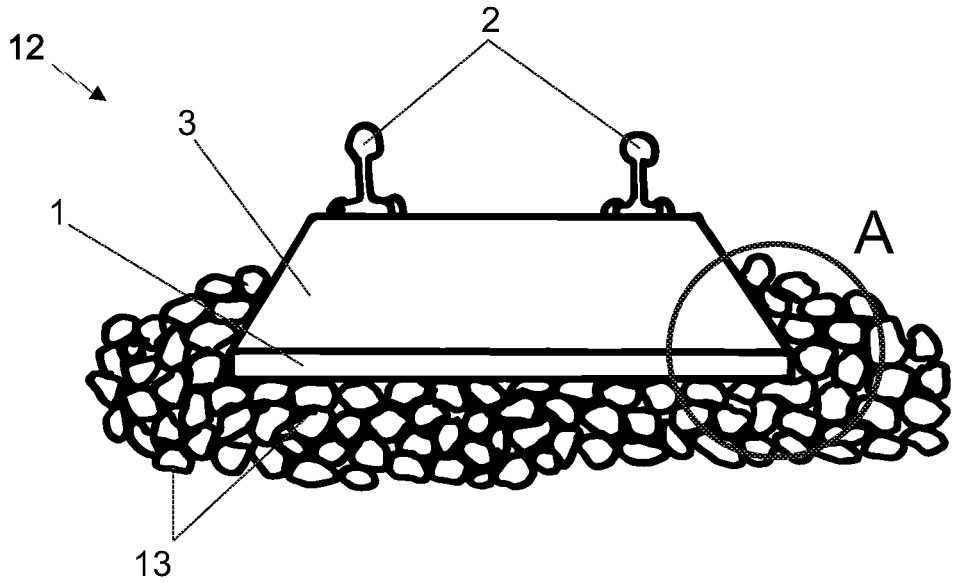
FIG. 1 shows a schematic section through one exemplary embodiment of a track system.

FIG. 1 shows a section through one exemplary embodiment of a track system 12 comprising at least one sleeper 3, rails 2 arranged on the sleeper 3, and at least one under sleeper pad 1 arranged, preferably fastened, underneath the sleeper 3, with the under sleeper pad 1 being in the usual operating position.

In this illustration, the under sleeper pad 1 is shown as a unit without its individual layers. The individual layers are illustrated only in the following figures.

Figure 2:
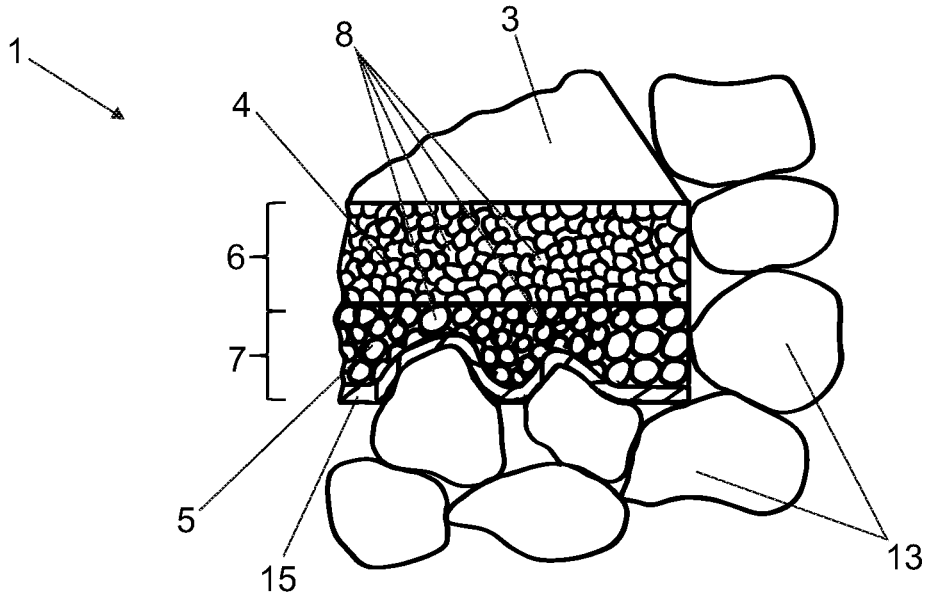
FIG. 2 shows an enlarged detail of the exemplary embodiment of a track system of FIG. 1 in the region A.

FIG. 2 shows a detail, or a close-up, of the track system 12 shown in FIG. 1 with the first exemplary embodiment of an under sleeper pad 1 in the region A, the under sleeper pad 1 comprising at least one first material component 4 and at least one second porous material component 5 different than the first material component 4, the first material component 4 being more elastic than the second material component 5 and the second material component 5 being more plastic than the first material component 4, and the first material component 4 being arranged exclusively in a first layer 6 of the under sleeper pad 1 and the second material component 5 being arranged exclusively in a second layer 7 of the under sleeper pad 1.

In this exemplary embodiment of the under sleeper pad 1, the first layer 6 is nearer the sleeper 3 and the second layer 7 is remote from the sleeper 3 and nearer to the ballast 13.

In this illustration according to FIG. 2, it is possible to clearly see how the ballast grains of the ballast 13 can penetrate the second, porous and more plastic layer 7, or can deform the second layer 7, and thus bring about a best-possible and also long-lasting form fit between the under sleeper pad 1 and the ballast 13. This form fit causes the ballast grains to be held in place particularly well and for a lengthy period of time underneath the sleeper 3 in the sense of the best possible ballast protection mentioned in the introduction.

Here, it is preferably provided that the second layer 7 has a compression set of at least 10%, preferably up to 24.5%.

The first, more elastic material component 4, which is present exclusively in the first layer 6, ensures particularly good vibration damping.

In this exemplary embodiment of the under sleeper pad 1, the first layer 6 and the second layer 7 each consist of granulate grains 8 connected to one another, in particular adhesively bonded to one another.

In this exemplary embodiment, a protective layer 15 for protecting the under sleeper pad 1 is arranged on the underside of the under sleeper pad 1, the protective layer 15 protecting the under sleeper pad 1 at least against excessive mechanical loading applied by the ballast 13.

The protective layer 15 may be a nonwoven, a film, a mesh or the like, as is known per se from the prior art. In general, in the case of under sleeper pads 1 and also track systems 12 according to the invention, such a protective layer 15 may be present but may also be omitted.

It is also generally conceivable for the under sleeper pad 1 to have further layers with additional functions, such as for noise reduction, for sealing, for frost or heat protection, etc.

In the following description of the exemplary embodiments of an under sleeper pad 1 that are shown in FIGS. 3-6, where there are differences, primarily the differences relating to the first exemplary embodiment according to FIGS. 1 and 2 will be discussed to avoid repetitions. The above description of the first exemplary embodiment applies in all other respects, insofar as it is also applicable to the exemplary embodiments of an under sleeper pad 1 which have yet to be shown and described in FIGS. 3-6 below.

FIGS. 3-6 show that the first layer 6 and the second layer 7 are preferably connected to one another, in particular adhesively bonded to one another, in contact with one another over all of one face.

In all these exemplary embodiments, a respective protective layer 15 for protecting the under sleeper pad 15 is also placed.

Furthermore, in all these exemplary embodiments, a connecting layer 14 for connecting the under sleeper pad 1 to the sleeper 3 is present.

The connecting layer 14 may be for example a nonwoven, flock, mesh or the like, which can be connected to the sleeper 3 in a form fit, in particular in the uncured state of the concrete of the sleeper 3.

It may also be the case that the connecting layer 14 is a layer of adhesive.

Different variants and technologies known per se from the prior art can be used for the design of such a connecting layer 14.

In the case of under sleeper pads 1 according to the invention, a connecting layer 14 may, but does not necessarily have to, be present. The connection between the sleeper 3 and the under sleeper pad 1 may in principle also be made by a frictional engagement, or force fit.

Furthermore, in all the exemplary embodiments disclosed here, an intermediate layer 16 for connecting the first layer 6 and the second layer 7 may be present.

The intermediate layer 16 may for example be a nonwoven, hook-and-loop closure, woven fabric, mesh or the like, which connects the first layer 6 and the second layer 7 to one another in a form fit.

It may also be the case that the intermediate layer 16 is an integrally bonded, for example chemical and/or thermal, connecting layer which can be produced, for example, by adhesive bonding, welding, laminating, pressing or the like.

A one-component polyurethane binder, such as isocyanate, or else a two-component polyurethane binder or another binder known per se or mixtures of these binders can be used both to connect or adhesively bond possibly present granulate grains 8 in the first layer 6 and/or the second layer 7 to one another and to adhesively bond the connecting layer 14 and/or the protective layer 15 on the respective layer 6 and/or 7 and to adhesively bond the layers 6 and 7 to one another by means of the intermediate layer 16.

It is also conceivable for the connection between the first layer 6 and the second layer 7 to also be made by frictional engagement, or a force fit.

Preferably, the first layer 6 has a thickness 9 in the range of 3 mm to 15 mm, preferably 4 mm to 12 mm, in particular which is between 40% and 85%, preferably between 50% and 75%, of an overall thickness 11 of the under sleeper pad 1.

Preferably, the second layer 7 has a thickness 10 in the range of 3 mm to 10 mm, preferably 4 mm to 8 mm, in particular which is between 15% and 60%, preferably between 25% and 50%, of the overall thickness 11.

Figure 3:
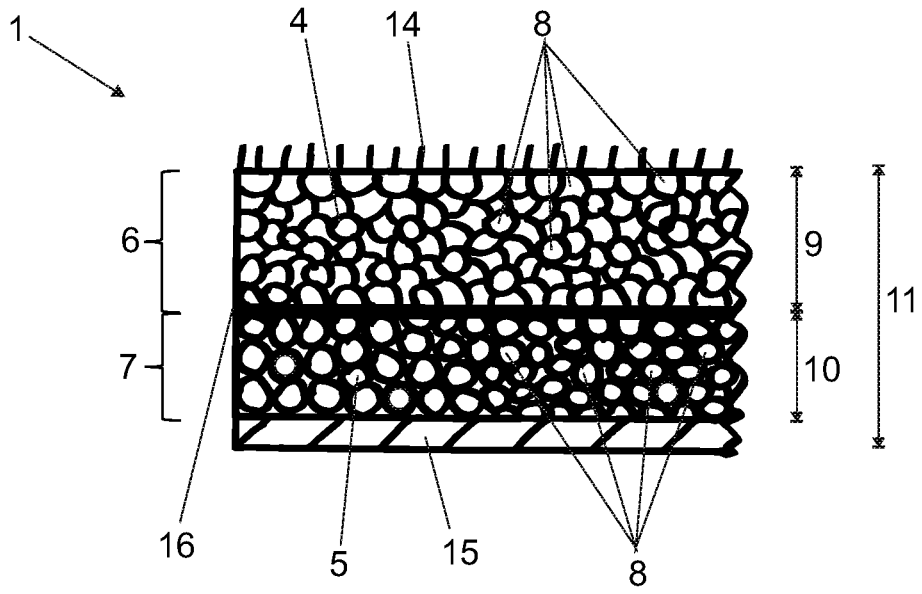
FIGS. 3-6 show schematic sectional illustrations of four exemplary embodiments of an under sleeper pad.

FIG. 3 shows an exemplary embodiment of an under sleeper pad 1 analogous to FIG. 2, in which the at least one first material component 4 of the first layer 6 and the at least one second material component 5 of the second layer 7 each consist of granulate grains 8 connected to one another, in particular adhesively bonded to one another.

Figure 4:
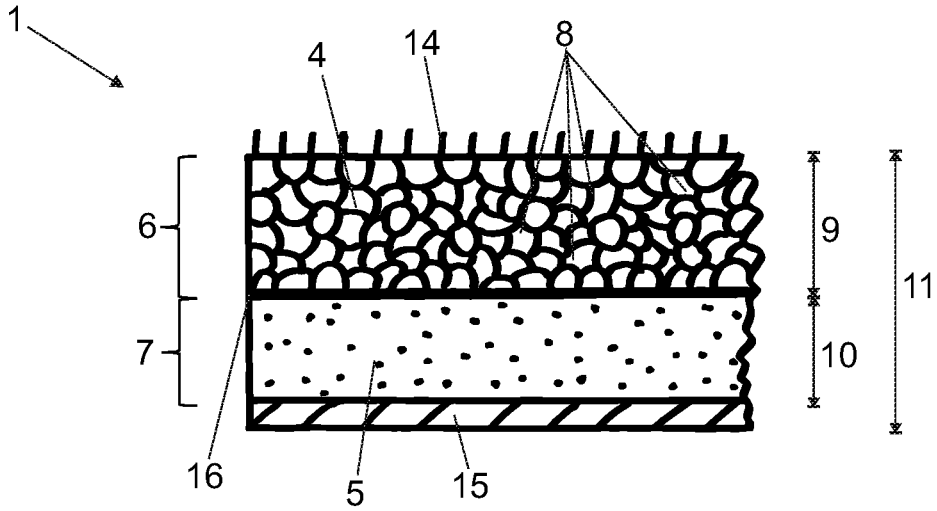

FIG. 4 shows an exemplary embodiment of an under sleeper pad 1, in which the at least one first material component 4 of the first layer 6 consists of granulate grains 8 connected, in particular adhesively bonded, to one another, and the second material component 5 of the second layer 7 consists of an intrinsically homogeneous mono-material.

Figure 5:
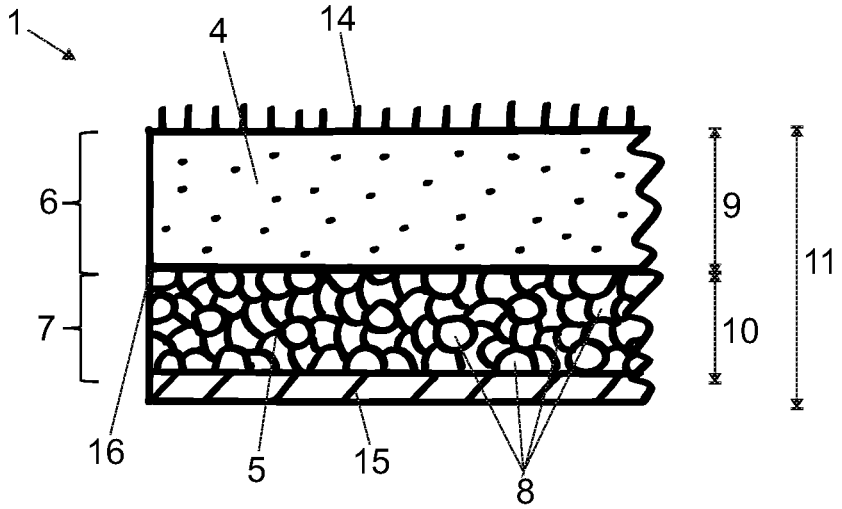

FIG. 5 shows an exemplary embodiment of an under sleeper pad 1, in which the first material component 4 of the first layer 6 consists of a mono-material and the second material component 5 of the second layer 7 consists of granulate grains 8 connected, in particular adhesively bonded, to one another.

Figure 6:
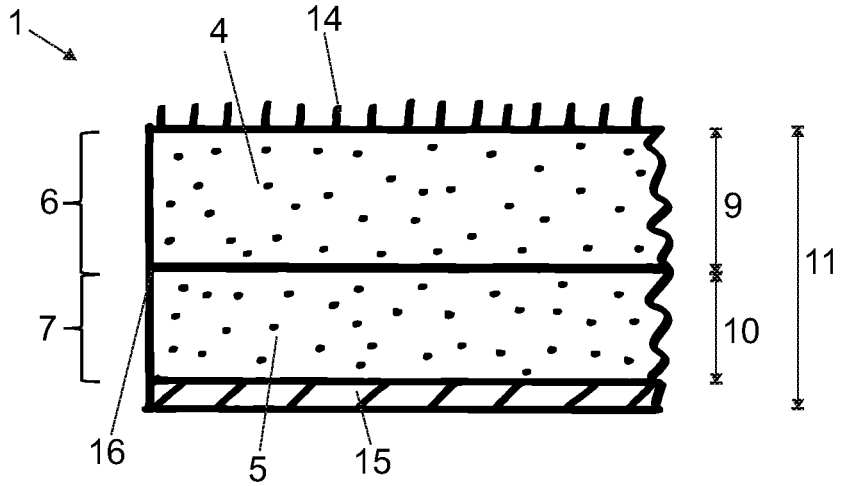

FIG. 6 shows an exemplary embodiment of an under sleeper pad 1, in which the first material component 4 of the first layer 6 and the second material component 5 of the second layer 7 each consist of a mono-material.

LIST OF REFERENCE SIGNS

1 Under sleeper pad
2 Rails
3 Sleeper
4 First material component
5 Second material component
6 First layer
7 Second layer
8 Granulate grains
9 Thickness (of the first layer)
10 Thickness (of the second layer)
11 Overall thickness
12 Track system
13 Ballast
14 Connecting layer
15 Protective layer
16 Intermediate layer

The invention claimed is:

1. An under sleeper pad for fastening to an underside, situated opposite rails, of a sleeper, the under sleeper pad comprising:

at least one first material component;

at least one second material component that is porous and is different than the first material component;

the at least one first material component is more elastic than the at least one second material component and the at least one second material component is more plastic than the at least one first material component; and wherein the at least one first material component is arranged exclusively in a first layer of the under sleeper pad and the at least one second material component is arranged exclusively in a second layer of the under sleeper pad.

2. The under sleeper pad as claimed in claim 1, wherein the at least one first material component is porous.

3. The under sleeper pad as claimed in claim 1, wherein the first is nearest to the sleeper and the second layer is remote from the sleeper in an operating position of the under sleeper pad.

4. The under sleeper pad as claimed in claim 1, wherein the first layer and the second layer are connected to one another in contact with one another over all of one face.

5. The under sleeper pad as claimed in claim 4, wherein the first layer and the second layer are adhesively bonded to one another.

6. The under sleeper pad as claimed in claim 1, wherein the first layer is formed from granulate grains connected to one another, and the granulate grains consist of the at least one first material component.

7. The under sleeper pad as claimed in claim 6, wherein the granulate grains of the at least one first material component of the first layer have a grain size in a range of 1 mm to 20 mm.

8. The under sleeper pad as claimed in claim 1, wherein the second layer is formed from granulate grains connected to one another, and the granulate grains consist of the at least one second material component.

9. The under sleeper pad as claimed in claim 8, wherein the granulate grains of the at least one second material component of the second layer are comprised of cork and have a grain size in a range of 0.1 mm to 10 mm.

10. The under sleeper pad as claimed in claim 8, wherein the granulate grains of the second material component of the second layer are comprised of polyurethane and have a grain size in a range of 1 mm to 20 mm.

11. The under sleeper pad as claimed in claim 1, wherein at least one of a) the first layer comprises an intrinsically homogeneous layer consisting of the at least one first material component as mono-material, or b) the second layer comprises an intrinsically homogeneous layer consisting of the at least one second material component as mono-material.

12. The under sleeper pad as claimed in claim 1, wherein at least one of a) the first layer has a smaller compression set than the second layer, b) the first layer has a compression set less than or equal to 8%, or c) the second layer has a compression set of at least 10%.

13. The under sleeper pad as claimed in claim 1, wherein the at least one first material component is a polyurethane having a porosity in a range of 0% to 90%, and at least one of: a) the at least one second material component is a porous polyurethane having a porosity in a range of 2.5% to 90%, or b) the at least one second material component is a porous cork having a porosity in a range of 2.5% to 90%.

14. The under sleeper pad as claimed in claim 1, wherein at least one of:

a) the first layer has a thickness in a range of 3 mm to 15 mm, b) the second layer has a thickness in a range of 3 mm to 10 mm, c) the first layer has a thickness which is between 40% and 85% of an overall thickness of the under sleeper pad, or d) the second layer has a thickness which is between 15% and 60% of the overall thickness of the under sleeper pad.

15. A track system comprising:

at least one sleeper;

rails arranged on the sleeper; and at least one under sleeper pad as claimed in claim 1 arranged underneath the sleeper, the first layer of the under sleeper pad being nearest to the sleeper and the second layer of the under sleeper pad being remote from the sleeper.

* * * * *